United States Patent [19]

Heitzman et al.

[11] 4,297,742

[45] Oct. 27, 1981

[54] ENGINE AND FUEL SHUTDOWN CONTROL

[75] Inventors: Gary N. Heitzman, Washington; Clay L. Hutchings, Pekin; Gary L. Knepp, Eureka; Robert G. Miller, East Peoria, all of Ill.

[73] Assignee: Caterpillar Tractor Co., Peoria, Ill.

[21] Appl. No.: 1,816

[22] Filed: Jan. 8, 1979

Related U.S. Application Data

[62] Division of Ser. No. 823,770, Aug. 11, 1977, Pat. No. 4,150,654.

[51] Int. Cl.[3] ..... H01H 47/04

[52] U.S. Cl. ..... 361/154; 361/194

[58] Field of Search ..... 361/152, 154, 160, 194, 361/203; 123/179 L

[56] References Cited

U.S. PATENT DOCUMENTS

| | | | |
|---|---|---|---|
| 3,579,052 | 5/1971 | Kato et al. | 361/154 |
| 3,594,615 | 7/1971 | Cortelli | 361/154 |
| 3,628,102 | 12/1971 | Jauch et al. | 361/154 |
| 3,864,608 | 2/1975 | Normile et al. | 361/154 |
| 4,214,290 | 7/1980 | Sloan | 361/154 |

*Primary Examiner*—Harry E. Moose, Jr.

*Attorney, Agent, or Firm*—Phillips, Moore, Weissenberger, Lempio & Majestic

[57] ABSTRACT

A solenoid-operated fuel valve opens automatically when the engine is started to allow fuel to flow from a fuel tank to the engine and closes automatically when the engine throttle is moved to fuel-off position to shut down flow of fuel through the governor for the engine. In the event of an emergency, operation of a manual shutdown control will de-energize the fuel valve solenoid to shut off flow of fuel to the engine compartment and will also shut down the engine by energizing a solenoid to move the fuel rack for the governor to fuel-off position. Actuation of a fire-extenguisher system for the engine will automatically de-energize the fuel-valve solenoid and energize the fuel-rack solenoid. The fuel-rack solenoid remains energized for a timed period sufficient to ensure engine shutdown in emergency situations. Control circuits are provided to ensure that current to each of the solenoids is reduced to a low holding level after initial energization and pull-in of the solenoids and are also provided to protect against damage from excessive current in the event either solenoid is shorted.

30 Claims, 2 Drawing Figures

FUEL TANK
13
16
SOL.
17
14
15
GOVERNOR
11
12
ENGINE
10
SOL.
24
START MOTOR
23
FUEL SOLENOID DRIVER
33
RACK SOLENOID DRIVER
42
LATCH
41
S
R
Q
Q̄
OSC
32
LATCH
31
30 SEC TIMER
43
VB
V REG
POWER SUPPLY
21
DISCONNECT SWITCH
18
19
START SWITCH
22
THROTTLE PROXIMITY SWITCH
36
MANUAL SHUTDOWN
37
PRESSURE SWITCH
38
FIRE EXTINGUISHER SYSTEM
26
28
CHEMICAL SUPPLY
27

FUEL VALVE SOLENOID
RACK SOLENOID
OSC.
RESET
F/F
30SEC. TIMER
VB
VREG.
VREG
COM C
RT
+T
CL
S
D
R
Q
PI
HI

ENGINE AND FUEL SHUTDOWN CONTROL

This is a division of Ser. No. 823,770 filed Aug. 11, 1977 now U.S. Pat. No. 4,150,654.

BACKGROUND OF THE INVENTION

This invention relates to engine controls and more particularly to a control which will shut down an engine and shut off flow of fuel from the fuel tank in response to normal operating procedures or in response to emergency situations.

Typically, an engine is provided with a fuel system wherein fuel is delivered from a fuel tank through a throttle-controlled governor to the engine, the fuel system also including a solenoid-operated fuel valve in the fuel line to prevent flow from the tank when the engine is not in operation. In normal operation, the fuel valve is opened, the governor is moved by a throttle lever to fuel-on position and a start motor is energized to crank the engine and start it. With the engine in operation, the operator controls the speed thereof by adjustment of the governor. The engine is shut down by moving the throttle to fuel-off position so that no more fuel can flow through the governor to the engine. The fuel valve is turned off.

Additionally, solenoids are often used in conjunction with the governor to override the throttle and pull the fuel-rack of the governor to fuel-off position and thereby shut down the engine in case of emergency.

Further, engines, and vehicles in which such engines are used, are often equipped with a fire-extinguishing system which will release a suitable extinguishing fluid in the event of an engine fire. Some of such systems are manually operated while others have fire-sensors which cause the fire-extinguishing system to operate automatically in the event of a fire.

Such systems as generally described above have a number of deficiencies. Normal and emergency procedures oftentimes require different action on the part of the operator to control the fuel valve and engine shutdown. Fire-extinguishing systems are not tied in with the engine system, and require the operator to take affirmative action to shut down the engine and turn off flow of fuel to the engine compartment in case of a fire. Such action may not be taken at all if the engine is running unattended and a fire breaks out.

The solenoids presently used for the fuel valve and fuel rack also present problems. For example, the fuel-valve solenoid is designed to be energized as long as the engine is running, so that fuel will be continuously supplied to the engine. Normally, the flow of fuel through the valve will cool the solenoid. However, if the supply of fuel runs out, the cooling effect thereof will be removed and the power applied to the solenoid will often cause the coil to burn out.

Movement of the fuel rack to fuel-off position by solenoid actuation requires the use of a heavy-duty solenoid. The solenoids which are commercially available for this purpose typically have two coils in parallel, a low-resistance pull-in coil which develops the high power required to move the fuel rack to fuel-off position and a high-resistance hold-in coil which will hold the fuel rack in its fuel-off position once it has been moved thereto. A continued application of full power to the pull-in coil after it has completed its power stroke will cause it to burn out in a relatively short time. For this reason such solenoids are provided with contacts in series with the pull-in coil which open when the solenoid has pulled in, so that only the hold-in coil remains energized. Very often, however, trouble is encountered in the field in keeping the contacts properly adjusted. If the contacts open prematurely, before the solenoid has fully pulled in, the hold-in coil may not be able to hold the solenoid in, and it will drop out until the contacts close and the pull-in coil is re-energized. If the contacts fail to open on pull-in, the pull-in coil will remain energized and burn out.

Additionally, the use of solenoids presents problems in that the wiring harness to the solenoids may develop shorts to ground or the solenoids may be accidentally shorted by mechanics servicing the system. In either case, if power is being applied, or is thereafter applied to the solenoids, the shorts will adversely affect the functioning of the electrical system for the engine.

SUMMARY OF THE INVENTION

The present invention is directed to overcoming one or more of the problems set forth above.

According to the invention a control system is provided which will open the fuel valve automatically in response to normal procedures in the starting of the engine and which will close the fuel valve automatically in response to normal movement of the throttle to fuel-off position.

Also according to the invention the fuel valve will close automatically in response to operation of manual shutdown control, without further action on the part of the operator other than the operation of such control.

Still further according to the invention, the fuel valve will close automatically in response to actuation of the fire-extinguisher system, so that flow of fuel to the engine compartment is prevented in case of fire.

Further according to the invention, full power is applied to the fuel valve solenoid to open it and such power is automatically reduced so that only a holding current is supplied thereto during the remaining time that it is to be energized.

Also according to the invention, if the fuel-valve solenoid should be shorted, such condition is detected and application of power to the solenoid is automatically terminated.

Still further according to the invention, engine shutdown is accomplished by moving the fuel rack to fuel-off position either by manual control of the throttle or by energization of the fuel-rack solenoid, the energization of the fuel rack solenoid in turn being accomplished either by operation of the manual shutdown control or in automatic response to actuation of the fire-extinguisher system.

Also according to the invention, the fuel-rack solenoid is held energized for a predetermined period of time sufficient to ensure that the engine stops when an emergency shutdown sequence is initiated.

Further according to the invention, if the fuel-rack solenoid is shorted, such condition is detected and full power is not applied thereto.

Still further, if the pull-in coil of the fuel-rack solenoid remains fully energized for a period somewhat longer than the time required for pull-in, power to such coil is automatically reduced to a low level sufficient to hold the solenoid pulled in and to prevent it from burning out.

Also according to the present invention, the fuel-rack solenoid is de-energized, to provide restart capabilities, by either a manual operation wherein power is removed from the control circuits or automatically at the end of the timed period of emergency energization thereof.

Other objects and advantages of the present invention will be apparent in the course of the following detailed description thereof.

BRIEF DESCRIPTION OF THE DRAWINGS

In the drawings, forming a part of this application and in which like parts are designated by like reference numerals throughout the same.

DESCRIPTION OF THE PREFERRED EMBODIMENT

Figure 1:
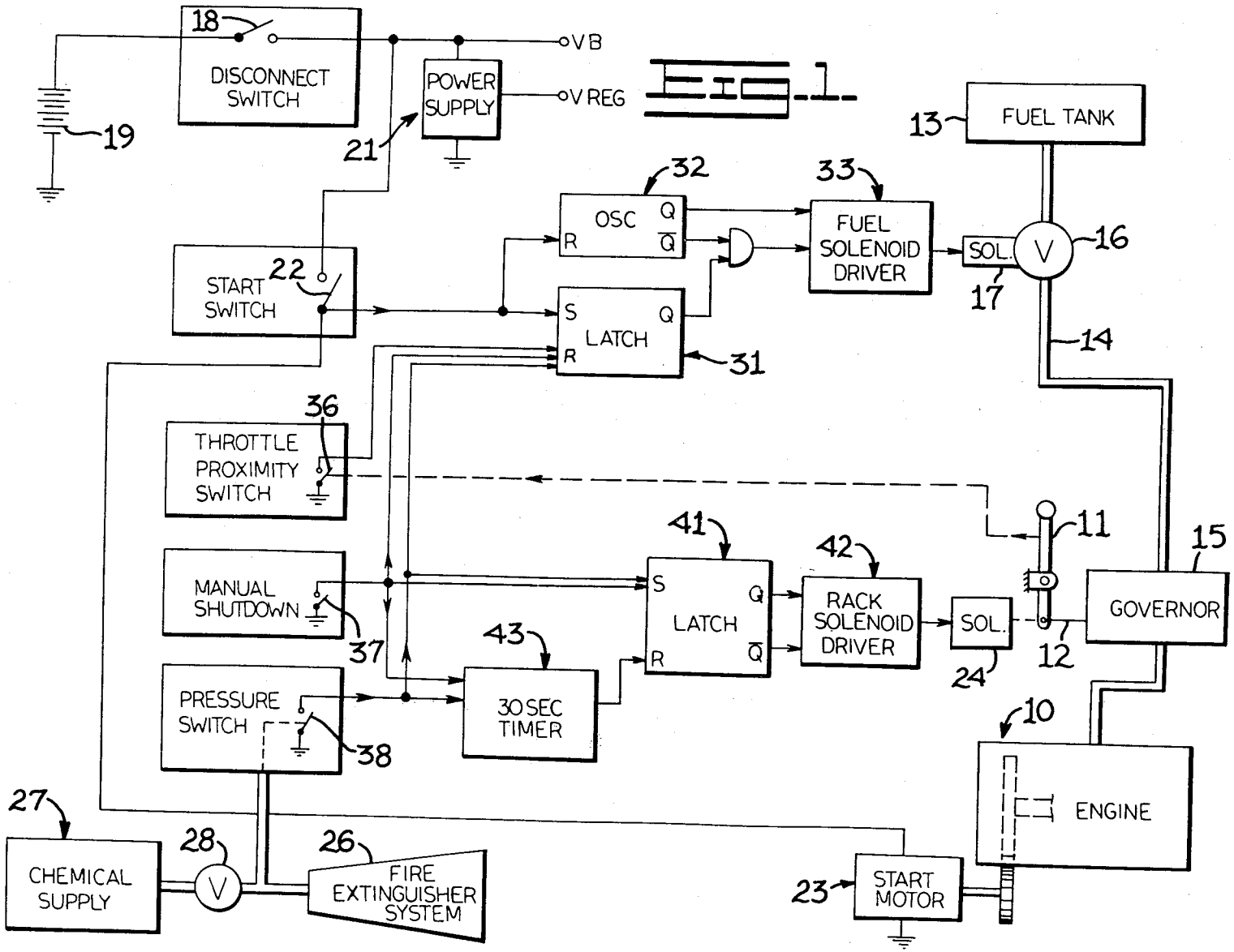
FIG. 1 is a generally block diagram of an engine and fuel supply system therefor, a fire-extinguisher system and control circuits for shutting off the fuel supply and engine.

Referring now to the drawings, FIG. 1 illustrates a simplified but functional engine control system for a vehicle having an engine 10, the system including a throttle lever 11 which reciprocates the fuel rack linkage 12 between fuel-off and full-fuel-on positions to control the amount of fuel flowing from fuel tank 13 through fuel line 14 and governor 15 to the engine. A normally-closed fuel valve 16 is disposed in fuel line 14, such valve being opened and held open by solenoid 17 during operation of the engine.

The engine is put into operation by first closing the main disconnect switch 18 to connect battery 19 to terminal $V_B$ and to the various usual operational circuits (not shown) of the vehicle which are connected to such terminal. Power supply 21 is also connected to battery 19 by closure of switch 18 and produces a regulated voltage $V_{REG}$ therefrom which is used to power the electronic control circuits to be described hereinafter.

The operator then moves start switch 22 to its start, or closed, position to supply battery voltage to start motor 23 so that the engine is cranked and started. After the engine is started, the operator will open start switch 22 and will control the speed of the motor by means of the throttle lever 11.

The engine 10 is normally shut down by the operator by movement of the throttle lever 11 to fuel-off position, such movement causing the fuel rack linkage 12 to move to a position shutting off the flow of fuel through governor 15 to engine 10. In addition, a solenoid 24 is operatively associated with the fuel rack linkage to move such linkage to fuel-off position when the solenoid is enertized.

The vehicle is further equipped with a fire-extinguisher system 26 associated with the engine, such system being supplied with a suitable chemical from supply tank 27 whenever valve 28 is opened. As is conventional, in case of a fire in the engine compartment the fire-extinguisher system may be actuated by a manual opening of valve 28, or, a suitable fire-sensor may be provided to cause an automatic opening of such valve in case provided to cause an automatic opening of such valve in case of fire.

The control circuits of the present invention are utilized to control operation of the solenoids 17 and 24 associated with the fuel valve 16 and fuel rack linkage 12, respectively.

In general, the start switch 22 is used as a control switch for the operation of the fuel valve solenoid. Movement by the operator of such switch to its operative, or start, position will cause the electronic latch 31 to set and will inhibit operation of oscillator 32.

During the time that start switch 22 is closed, the fuel solenoid driver 33 will supply full current to solenoid 17, causing it to open the fuel valve 16. Once the engine is started, the operator will open start switch 22. This will then allow oscillator 32 to oscillate, so that its output, in conjunction with the output of latch 31, will cause the fuel solenoid driver 33 to supply a continuous, but reduced, holding current to solenoid 17 for as long as latch 31 remains set.

The fuel valve 16 will close in response to a number of conditions. First, an opening of the main disconnect switch 18 will remove power from the fuel solenoid driver so that the solenoid is de-energized, thus allowing valve 16 to move to its normally-closed position.

The fuel valve 16 will also close in response to a resetting of latch 31. In the present invention, such resetting will occur if any one of three conditions is present. First, manual movement of the throttle lever 11 to fuel-off position will cause throttle proximity switch 36 to close and reset latch 31. Secondly, closure of the manual shutdown switch 37 in the operator cab will cause such resetting. Thirdly, if valve 28 is opened to actuate the fire-extinguisher system 26, pressure-responsive switch 38 will close automatically in response to such actuation and will reset latch 31.

As mentioned previously, the fuel-rack linkage 12 can be moved to fuel-off position in response to manual movement of throttle lever 11 to fuel-off position. Additionally linkage 12 will be automatically moved to fuel-off position in response to a closing of either or both of manual shutdown switch 37 or the pressure switch 38. If either of these control switches is moved to its closed, or operative, position, latch 41 will be set and rack solenoid driver 42 will supply current to solenoid 24 causing it to pull in and hold the fuel-rack linkage 12 in fuel-off position. Closure of either control switch 37 or 38 will also start a thirty-second timer 43 into operation. At the end of the thirty seconds, latch 41 will be reset. The thirty-second timer will thus cause the rack solenoid driver to hold the solenoid 24 energized for a sufficiently long period of time to ensure that the engine is shut down, while allowing such engine to be restarted after the timer period ends.

Opening of the main disconnect switch 18 will also remove power from the fuel rack solenoid 24 so that it will be de-energized.

Figure 2:
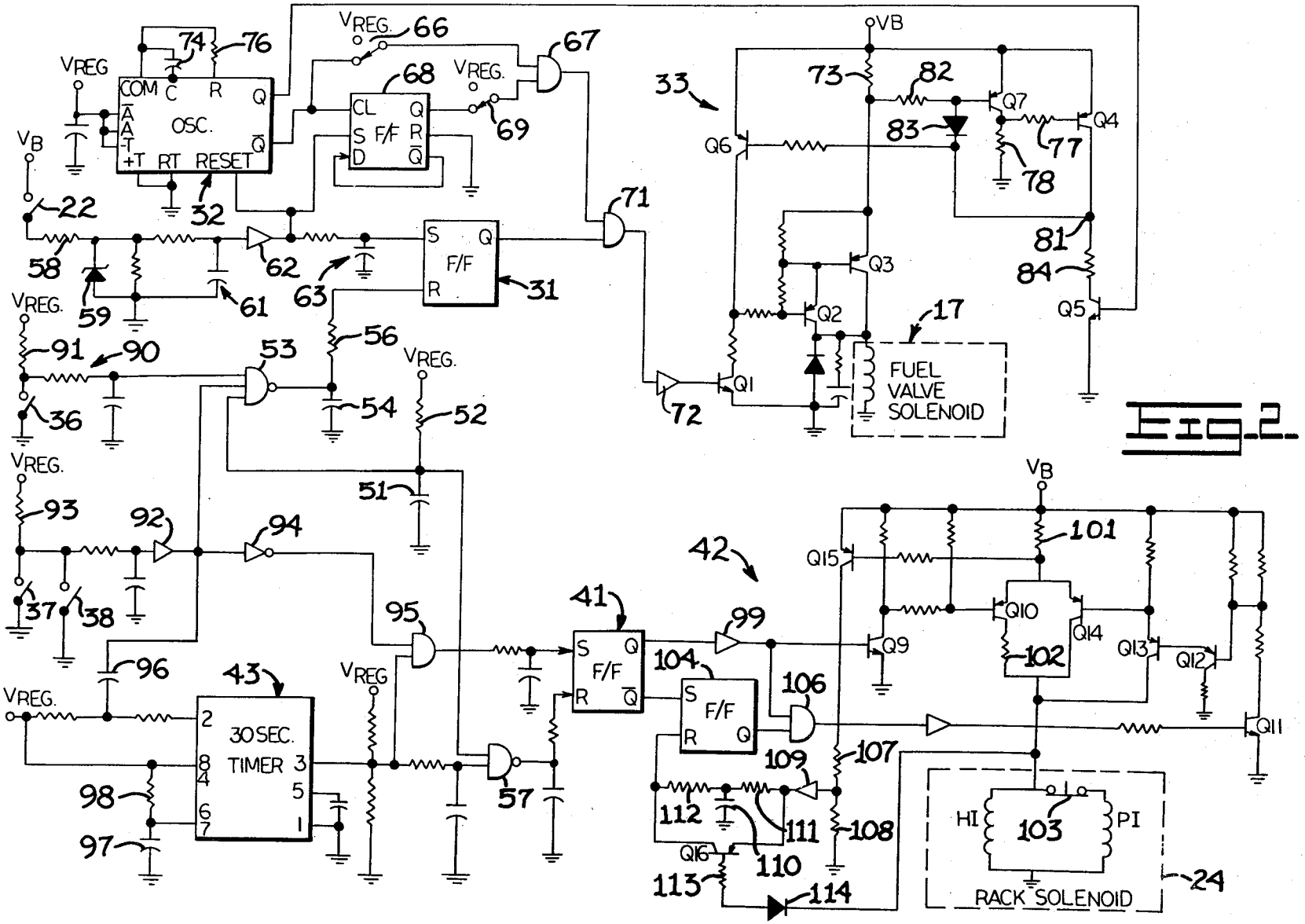
FIG. 2 is a circuit diagram of the control circuits of FIG. 1.

The details of the control circuits are shown in FIG. 2.

When power is first turned on and $V_{REG}$ is available from the power supply, capacitor 51 will begin to charge through resistor 52. The initially low voltage across capacitor 51 is applied to NAND gate 53 causing it to output a high so that the positive going voltage across capacitor 54 will apply a reset voltage through resistor 56 to flip-flop, or latch, 31. In the same manner, the initially low voltage across capacitor 51 is applied to NAND gate 57 so that flip-flop, or latch, 41 is reset. After power up, capacitor 51 will be charged to $V_{REG}$ and will apply a high to both of NAND gates 53 and 57, conditioning such gates to go high in the event that any other input of such gates goes low.

When start switch 22 is closed, in a starting of engine 10, a regulated voltage at the junction of resistor 58 and zener diode 59 will be applied through filter 61, buffer 62 and filter 63 to the set input S of flip-flop 31, causing the flip-flop to set so that its Q output goes high.

The high at the output of buffer 62 is also applied to the reset input of free-running oscillator 32, to prevent oscillation and hold the $\overline{Q}$ output thereof high. The $\overline{Q}$ output is connected through switch 66 to one of the inputs of AND gate 67. The $\overline{Q}$ output of oscillator 32 is also applied to the clock input CL of flip-flop 68. The Q output of flip-flop 68 is connected through switch 69 to the other input of AND gate 67. As a consequence, with start switch 22 closed, the $\overline{Q}$ output of oscillator 32 will be high, flip-flop 68 will be set and its Q output will be high so that the output of gate 67 will be high. The high output of gate 67 is anded with the high Q output of flip-flop 31 by AND gate 71, and the high output thereof is applied through buffer 72 to the base of transistor Q1 to turn it on. With transistor Q1 on, the voltage at the base of transistor Q2 drops so that it turns on and turns on power transistor Q3. Power transistor Q3 functions as a power switch to connect the fuel-valve solenoid 17 to the battery, so that current may flow from the battery through the low-resistance, current-sensing resistor 73 to the fuel-valve solenoid 17, causing such solenoid to pull in and open fuel valve 16.

After the engine is started and start switch 22 is opened, the reset voltage is removed from oscillator 32, allowing it to oscillate at a rate determined by the values of capacitor 74 and resistor 76. With the $\overline{Q}$ output of flip-flop 68 connected to its D input, flip-flop 68 will act as a frequency divider, with its Q output changing state at a rate which is one-half the frequency of oscillation of oscillator 32. As a consequence, the output of gate 67 will be high for only 25% of the time since the $\overline{Q}$ output of oscillator 32 will be high for only half of the time that the Q output of flip-flop 68 is high. With flip-flop 31 still set, the output of NAND gate 71 is high for only 25% of the time, and Q1 is conductive for only 25% of the time. As a result, Q2 and Q3 are on for 25% of the time and off for 75% of the time, reducing the average current to the fuel-valve solenoid to a low value sufficient to enable the solenoid to hold valve 16 open. The frequency of oscillation of oscillator 32 is, of course, sufficiently high that the solenoid 17 does not drop out during the time that Q3 is off.

As mentioned previously, under normal conditions, the flow of fuel through valve 16 will serve to cool the solenoid 17 even though full power is applied continuously thereto. However, if the fuel supply runs out, a full application of power to the solenoid of a standard, commercially-available solenoid valve will cause the temperature of the solenoid to rise rapidly to about 385° F. and the solenoid will burn out. The reduction of the duty cycle of the power applied to solenoid 17 after it is pulled in allows standard solenoid valves to be used without failure thereof in the event that the fuel supply is exhausted since the heat rise from the low holding current will be within rated limits.

Switches 66 and 69 are provided so that the duty cycle can be changed, if desired to do so. For example, if switch 69 is changed to connect the input of gate 67 to $V_{REG}$, while switch 66 is unchanged, the output of gate 67 will be high for 50% of the time, and transistors Q1, Q2 and Q3 will be on for 50% of the time. If switches 66 and 69 are both changed, so that $V_{REG}$ is applied to both inputs of gate 67, then the output of gates 67 and 71 will be high continuously, and transistors Q1, Q2 and Q3 will be on continuously for a 100% duty cycle.

Transistors Q4, Q5, Q6 and Q7 are provided to sense the existence of a shorted condition of the fuel-valve solenoid and to provide for overcurrent protection for the control. For example, if there is a short in the wiring harness to the fuel solenoid, or if the solenoid is accidentally shorted out by a mechanic servicing the system, excessive current will flow through transistor Q3.

Normally, the base of Q4 is connected to ground by resistors 77 and 78 and held low so that Q4 is on. The base of Q5 is connected to the Q output of oscillator 32 so that Q5 is continually being turned on and off when oscillator 32 is in operation, with Q5 being on during the time that Q2 and Q3 are turned on by Q1. With Q4 on, junction 81, at the collector of Q4, is high and Q6 is held off. Under normal current conditions, the voltage drop across resistor 73 is insufficient to turn Q7 on, and, thus, Q7 is normally off.

In the event that excessive current does flow through Q3, the increased voltage drop across current-sensing resistor 73 will immediately turn Q7 on. With Q7 on, its collector goes high and turns off Q4. The current flow through resistors 73 and 82, diode 83, resistor 84 and Q5 causes the potential at junction 81 to drop immediately so that Q6 goes on. This raises the potential at the bases of Q2 and Q3 so that they turn off to prevent further current flow through Q3. Thus, as soon as excessive current flows through Q3, such current is detected and Q3 is turned off.

When the oscillator 32 turns off transistor Q5, the interruption of current therethrough will turn Q7 off and Q4 on again, causing Q6 to go off.

If there is still a short when oscillator 32 turns on Q1 and Q5, and Q1 turns on Q2 and Q3, excessive current through Q3 will again turn off Q3 as described above. However, if the short has been removed, there will be no excessive current through resistor 73 and Q7 will remain off, allowing normal operation again.

Assuming that an overcurrent condition has not occurred, the fuel valve solenoid 17 will continue to be energized, at a reduced duty cycle, as long as the engine remains in normal running condition. Under normal circumstances the engine is shut down by movement of the throttle lever 11 to fuel-off position. At such time the throttle proximity switch 36 will close and will ground one of the inputs to NAND gate 53. Such input is normally tied to $V_{REG}$ through filter 90 and resistor 91. With a low input to gate 53, its output will go high and will reset flip-flop 31 so that its Q output goes low. This in turn will turn Q1, Q2 and Q3 off to de-energize the fuel-valve solenoid 17.

The fuel valve solenoid 17 can be immediately reenergized by moving the throttle lever 11 to a fuel-on position and by again closing the start switch.

The fuel valve solenoid 17 can also be turned off in response to the closing by the operator of the manual shutdown switch 37 or to automatic closing of pressure switch 38 in the event of a fire. The closure of either switch will ground the input to buffer 92 which is normally tied to $V_{REG}$ by resistor 93, and will cause buffer 92 to ground its input to gate 53 so that such gate outputs a high reset voltage to flip-flop 31 and thereby causes de-energization of solenoid 17.

Under normal operation, engine 10 is shut down by operating the throttle lever 11 to fuel-off position so that the rack linkage 12 will shut off flow of fuel through governor 15 to the engine. The present control circuit also causes emergency shutdown by the energization of fuel rack solenoid 24 in response to closing of the manual shutdown switch 37 or the automatic closing of pressure switch 38. Closure of either switch will cause buffer 92 to ground the input of inverter 94 so that it outputs a high to AND gate 95.

At the same time, closure of either switch will cause buffer 92 to apply a single trigger pulse by means of capacitor 96 to pin 2 of timer 43 (a Signetics SE 55SV timer may be used, such timer having the pin identification shown herein), causing such timer to produce a single pulse at its output pin 3. The length of the pulse is determined by the values of capacitor 97 and resistor 98 and is preferably in the order of thirty seconds. The use of buffer 92 makes the threshold trigger level of timer 43 independent of the contact resistance of switches 37 and 38.

The timer pulse is applied to gate 95 so that a high set voltage is applied to flip-flop 41 at the beginning of the pulse. With flip-flop 41 set, its high Q output is applied through buffer 99 to the base of transistor Q9 to turn it on. With Q9 on, Q10 will turn on, allowing current to flow through the low-resistance current-sensing resistor 101, Q10 and the relatively high-resistance current-limiting resistor 102 to the fuel rack solenoid 24.

As shown herein fuel rack solenoid 24 is a typical solenoid available for the present use and comprises a double coil solenoid having a low-resistance pull-in coil PI and a high-resistance hold-in coil HI connected in parallel with each other. Normally closed contacts 103 are provided in series with the PI coil, these contacts being mechanically actuated by the solenoid core (not shown) to open position when the core is pulled in.

Initially, flip-flop 41 will have been reset so that its $\overline{Q}$ output will set flip-flop 104. Accordingly, when flip-flop 41 is set, the Q output of both flip-flops 41 and 104 will cause AND gate 106 to output a high to the base of transistor Q11 to turn it on. This in turn causes amplifier transistor Q12 to turn on, lowering the base of Q13 to turn it on. Power transistor Q14 is thereby turned on, this transistor functioning as a power switch means to connect solenoid 24 to the battery so that full current, e.g., about 16 amps, is supplied to both coils of the rack solenoid.

The pull-in coil of a standard, commercially-available rack solenoid will pull in the solenoid in somewhat less than 350 milliseconds. If the contacts 130 open as they should, the pull-in coil is taken out of the circuit, leaving only the relatively high-resistance hold-in coil connected to the battery. In such case, the current to the solenoid drops, e.g., to about 0.4 amps.

The present control will provide for current reduction to solenoid 24 in case contacts 103 fail to open when the solenoid is pulled in.

When full current is flowing to both coils of the solenoid, sufficient potential drop across the current-sensing resistor 101 will be developed so that Q15 turns on and conducts through voltage dividing resistors 107 and 108, causing the output of buffer 109 to go high. Capacitor 110 can now charge to such high through resistor 111. Capacitor 110 and resistor 111 function as a timer, these components having values such that at the end of a predetermined time, approximately 350 milliseconds (somewhat longer than the time normally required for the fuel rack solenoid to pull in), capacitor 110 will have charged to a level sufficient to apply, through resistor 112, a reset voltage signal to flip-flop 104.

If the contacts 103 of the fuel rack solenoid do open as they should before capacitor 110 charge sufficiently to reset flip-flop 104, the reduced 0.4-amp current through current-sensing resistor 101 will be insufficient to keep Q15 on, and it will turn off. This will stop the operation of the capacitor 110-resistor 111 timer so that it is inhibited from resetting flip-flop 104.

However, if contacts 103 fail to open in response to pull-in and the pull-in coil remains energized, Q15 will continue to conduct so that the 350 millisecond timer times out and resets flip-flop 104. The Q output of flip-flop 104 goes low, the output of AND gate 106 goes low and Q11, Q12 and Q13 are turned off. This turns off the power transistor Q14 so that current to both coils of the rack solenoid now goes only through Q10 and the current-limiting resistor 102. Current to the solenoid is thus reduced to a low value, e.g., about 1 amp, a value sufficient to hold the solenoid in while preventing the pull-in coil from burning out.

Thus, if a standard, dual-coil fuel rack solenoid is used, the control circuit will allow reduced holding current to flow through power transistor Q14 to the hold-in coil in the event the contacts 103 function properly while providing for holding current flow through resistor 102 to both coils in the event contacts 103 fail to open.

As may be appreciated, the control will allow a single-coil rack solenoid to be used, since it provides automatic current-limiting at the end of the period of the capacitor 110-resistor 111 timer.

In either event, whether the hold-in coil alone is energized through Q14 or whether both coils are energized through Q10, the rack solenoid will be held in for thirty seconds.

At the end of the thirty-second period of timer 43, its output will go low so that NAND gate 57 will reset flip-flop 41. With the Q output of flip-flop 41 now low, Q9 will turn off to stop conduction of Q10. Also, the output of gate 106 will go low to turn off Q11, Q12, Q13 and Q14. With Q10 and Q14 both off, the rack solenoid will be de-energized.

Thus, once an emergency shutdown is initiated, the thirty-second timer 43 will ensure that the rack solenoid is energized for a time sufficient to cause the engine 10 to be shut down. At the same time, the emergency shutdown circuit resets itself after the thirty-second period so that the operator may restart the engine if he deems it advisable to do so.

Transistor Q16 is provided to sense the existence of a shorted condition of the fuel rack solenoid and to provide protection against excessive current flow through power transistor Q14 as might happen in the event of an accidental shorting of the rack solenoid. Transistor Q16 is connected across resistors 111 and 112 and has its base connected through resistor 113 and diode 114 to the power side of solenoid 24. Under normal conditions there will be a sufficient voltage drop, e.g., about 10 volts, across solenoid 24 so that transistor Q16 is held off. In the event of a short condition, the voltage drop across solenoid 24 will be sufficiently low so that transistor Q16 is turned on and it will short out resistors 111 and 112 so that buffer 109 will apply an immediate reset voltage to flip-flop 104 which thereby turns off transistors Q11, Q12, Q13 and Q14. Conduction will still occur through Q10 but resistor 102 will limit such current to an acceptable value even if the solenoid is shorted, and such conduction will cease at the end of the 30-second time period of timer 43.

As may be seen from the foregoing, the present circuits apply full power to the fuel valve and fuel rack solenoids to actuate the solenoids, with such power being then automatically reduced so that only a holding current is supplied during the remaining time that they are to be energized.

This is accomplished with regard to the fuel valve solenoid by turning Q3 on and leaving it on during the time required for the solenoid to pull in. After that, Q3 is cyclically turned off and on so that the average current supplied to the solenoid is substantially reduced and yet sufficient to hold it in. This operation of the solenoid by a reduction in duty cycle is advantageous in that it provides the desired limiting of current to the solenoid without requiring a dissipation of excess energy as heat in the control. For a continuous duty circuit such as that for the fuel valve, a heat rise in the control would jeopardize component reliability and increase the cost of such components. Such a circuit is quite useful for a relatively low power solenoid such as that which would be used for the fuel valve. However, it is not as suitable for a relatively high-power solenoid, such as would be used for the fuel rack, because of the potential transistor deterioration due to the high currents which would have to be used during the periods of conduction to maintain proper solenoid energization.

The technique used herein for the fuel rack solenoid, namely, of applying full power to the solenoid through transistor Q14 and then reducing the power by turning Q14 off and supplying current to the solenoid through the alternate path of transistor Q10 and resistor 102 is a reliable and cost-effective technique when high-power solenoids having a relatively short period of operation are involved. Such current-limiting, by resistor 102, does cause some heat rise in the control but the relatively short length of time involved does not make for an unacceptable level of rise.

The embodiments of the invention in which an exclusive property or privilege is claimed are defined as follows:

1. Apparatus for controlling solenoid operation comprising:

a solenoid, a source of electrical energy, a control switch having an operative position, a settable and resettable latch means, means for setting said latch means in response to movement of said control switch to its operative position, means for connecting said solenoid to said source of electrical energy in response to movement of said control switch to its operative position and for supplying full current to said solenoid from said source for a desired period of time following such switch movement, means for automatically reducing the level of current flowing from said source to said solenoid at the end of said desired period of time and for maintaining said reduced-level current to said solenoid for as long as said latch means is set, means for resetting said latch means and for thereby terminating the flow of current from said source to said solenoid.

2. Apparatus as set forth in claim 1 and further including means for sensing the existence of a shorted condition of said solenoid and for preventing full flow of current from said source of electrical energy to said solenoid in such event.

3. Apparatus as set forth in claim 1 and further including:

means responsive to the level of current flowing from said source of electrical energy through said connection for interrupting said current flow when the level of such current exceeds a predetermined value.

4. Apparatus as set forth in claim 1 and further including:

means responsive to the level of current flowing from said source of electrical energy through said connection for interrupting said current flow when the level of such current exceeds a predetermined amount and for allowing a resumption of such current flow after a predetermined period of time following such interruption.

5. Apparatus as set forth in claim 1 and further including:

means responsive to the voltage level across said solenoid for substantially reducing the flow of current from said source of electrical energy to said solenoid when the voltage level across said solenoid is below a predetermined value.

6. Apparatus as set forth in claim 1, wherein the means for reducing the level of current includes a power switch means in series with said solenoid and includes means for repeatedly and rapidly opening and closing said power switch means to reduce the average flow of current to said solenoid.

7. Apparatus as set forth in claim 6 and further including:

means for sensing a shorted condition of said solenoid and for opening said power switch means immediately in the event a shorted condition is sensed.

8. Apparatus as set forth in claim 6 and further including:

means responsive to the level of current flow through said power switch means when said switch means is closed and for immediately opening said power switch means in the event the level of current flow therethrough exceeds a predetermined value.

9. Apparatus as set forth in claim 6 wherein said means for repeatedly opening and closing said power switch means includes means for initiating such operation in response to movement of said control switch from its operative position.

10. Apparatus as set forth in claim 6 wherein said means for terminating the flow of current from said source to said solenoid includes means responsive to the resetting of said latch means for inhibiting closing of said power switch means.

11. Apparatus as set forth in claim 1 wherein said means for connecting said solenoid to said source includes means responsive to the condition of said latch means for enabling said connection when said latch means is set and wherein said means for terminating flow of current from said source to said solenoid includes means responsive to the condition of said latch means for terminating such flow when said latch means is set.

12. Apparatus as set forth in claim 1, wherein the means for connecting said solenoid to said source of electrical energy for allowing full current to flow to said solenoid comprises a power switch means in series with said solenoid, and wherein the means for reducing the level of current includes a current-limiting resistor connected across said power switch means and includes means operable at the end of said desired period of time for opening said power switch means.

13. Apparatus as set forth in claim 12, wherein said means for terminating flow of current from said source to said solenoid includes a switch device in series with said resistor, and means for closing said switch device in response to setting of said latch means and for opening said switch device in response to resetting of said latch means.

14. Apparatus as set forth in claim 13 and further including a timer means having a predetermined time period, means for starting said timer signal in response to said movement of said control switch to operative position and wherein said means for resetting said latch means includes means for resetting said latch means in response to the end of said predetermined time period.

15. Apparatus as set forth in claim 12, and further including means for sensing the existence of a shorted condition of said solenoid and for opening said power switch means immediately and prior to the end of said desired period of time in the event a shorted condition is sensed.

16. Apparatus as set forth in claim 12 and further including means responsive to the level of potential drop across said solenoid for opening said power switch means immediately and prior to the end of said desired period of time in the event the level of potential drop across said solenoid is below a predetermined value.

17. Apparatus as set forth in claim 14 and further including a second timer means having a time period equal to said desired period of time, means for beginning said second timer into operation when said power switch means is closed, and wherein said means operable at the end of said desired period of time for opening said power switch means includes means responsive to the end of said time period of said second timer means.

18. Apparatus as set forth in claim 1 and further including:

a timer means having a time period equal to said desired period of time, means for beginning said timer means into operation substantially at the time that said solenoid is connected to said source of electrical power for supply of full current to said solenoid, and wherein said means for automatically reducing the level of current flowing to said solenoid is responsive to the end of the time period of said timer means.

19. Apparatus for controlling solenoid operation comprising:

a solenoid, a d.c. voltage source, means including a power transistor in series with said solenoid for connecting said solenoid to said source, a control switch having an operative position, a settable and resettable latch means, means responsive to movement of said control switch to its operative position for setting said latch means, means for turning said power transistor on and for maintaining said power transistor on as long as said control switch is in its operative position, means for repeatedly turning said power transistor off and on when said control switch is other than in its operative position and for as long as said latch means is set, and for preventing said power transistor from turning on when said latch means is reset, means for resetting said latch means.

20. Apparatus as set forth in claim 19 and further including:

means for sensing the existence of a shorted condition of said solenoid, means for immediately turning said power transistor off in the event a shorted condition of said solenoid is sensed.

21. Apparatus as set forth in claim 19 and further including:

means for sensing the level of current flow through said power transistor, means responsive to said sensing means for turning said power transistor off in the event the level of current flow therethrough is above a predetermined value.

22. Apparatus as set forth in claim 19 wherein said means for repeatedly turning said power transistor on and off includes an oscillator means and means for turning on said power transistor for a portion of each cycle of operation of said oscillator means and for turning said power transistor off for the remaining portion of each cycle of operation of said oscillator means, said oscillator means having a frequency of operation which is sufficiently high that the length of time in each cycle of operation when said power transistor is turned off is less than the drop-out time of said solenoid.

23. Apparatus as set forth in claim 22 wherein said means for maintaining said power transistor on as long as said control switch is in its operative position includes means responsive to said control switch being in such position for inhibiting operation of said oscillator means and maintaining said oscillator means in a state wherein said power transistor is turned on continuously.

24. Apparatus as set forth in claim 22 and further including:

means for sensing the existence of a shorted condition of said solenoid, means responsive to the sensing of a shorted condition of said solenoid by said sensing means for immediately turning said power transistor off and for maintaining said power transistor off during the remainder of the portion of the cycle of operation of said oscillator means wherein said power transistor is normally held on by said oscillator means.

25. Apparatus as set forth in claim 24 wherein said means responsive to said sensing means includes means responsive to the operation of said oscillator means for enabling said power transistor to be turned on again in the next cycle of operation of said oscillator means.

26. Apparatus for controlling solenoid operation comprising:

a solenoid, a d.c. voltage source, means including a power transistor in series with said solenoid for connecting said solenoid to said source, a second transistor and a current-limiting resistor connected in series with each other, said second transistor and resistor being connected across said power transistor, a control switch having an operative position, a first timer means for generating a signal of predetermined duration, means for starting said first timer means into operation in response to movement of said control switch to its operative position, means responsive to the beginning of said first timer means signal for turning said power transistor and said second transistor on and responsive to the end of said signal for turning said second transistor off, a second timer means for generating a signal at the end of a predetermined period of time which is substantially less than that of said first timer means, means responsive to the flow of energizing current through said power transistor to said solenoid for starting said second timer means into operation, means responsive to said second timer means signal for turning said power transistor off.

27. Apparatus as set forth in claim 26 and further including:

means for sensing the existence of a shorted condition of said solenoid, means responsive to said sensing means for immediately turning said power transistor off in the event a shorted condition is sensed and for maintaining said power transistor off for the remainder of the time period of said first timer means.

28. Apparatus as set forth in claim 26 wherein said means for starting said second timer into operation includes means for sensing the level of current flowing to said solenoid and means responsive to said sensing means for starting said second timer means into operation and maintaining such timer in operation when and for as long as the level of said current is greater than a predetermined amount and for stopping the operation of such timer and inhibiting the generation of the signal thereof if the level of said current becomes less than said predetermined amount.

29. Apparatus as set forth in claim 28 and further including:

means operable during the time period of said first timer means and responsive to the potential drop across said solenoid for immediately turning said power transistor off in the event the potential drop across said solenoid is less than a predetermined amount and for maintaining said power transistor off for the remainder of the time period of said first timer means.

30. Apparatus as set forth in claim 28 wherein said solenoid comprises parallel connected pull-in and hold-in coils and includes normally-closed contacts in series with said pull-in coil which contacts are opened upon pull-in of said solenoid.

* * * * *